United States Patent [19]

Day, Jr.

[11] Patent Number: 4,540,989

[45] Date of Patent: Sep. 10, 1985

[54] WHIP ANTENNA ASSEMBLY EXHIBITING INCREASED DURABILITY

[75] Inventor: Samuel W. Day, Jr., Miramar, Fla.

[73] Assignee: Motorola, Inc., Schaumberg, Ill.

[21] Appl. No.: 510,853

[22] Filed: Jul. 5, 1983

[51] Int. Cl.[3] ..... H01Q 1/20; H01Q 9/30

[52] U.S. Cl. ..... 343/900

[58] Field of Search ..... 343/715, 846, 900, 702

[56] References Cited

U.S. PATENT DOCUMENTS

| | | | |
|---|---|---|---|
| 2,144,038 | 1/1939 | Trump | 343/900 |
| 2,206,821 | 7/1940 | Mydlil | 343/715 |
| 2,214,685 | 9/1940 | Stone, Jr. | 343/900 |
| 2,391,202 | 12/1945 | Tellander et al. | 343/900 |
| 2,397,151 | 3/1946 | Mitchell | 343/888 |
| 2,419,611 | 4/1947 | Walsh | 343/888 |
| 2,493,787 | 1/1950 | Torretti | 343/900 |
| 2,558,763 | 7/1951 | Lee | 343/888 |
| 3,944,722 | 3/1976 | Larsen | 343/715 |
| 4,360,814 | 11/1983 | Wells . | |
| 4,435,713 | 3/1984 | Casparaitis et al. | 343/895 |

*Primary Examiner*—Eli Lieberman

*Attorney, Agent, or Firm*—Joseph T. Downey; Mark P. Kahler; Daniel K. Nichols

[57] ABSTRACT

An antenna is provided which includes a first closely wound coil spring member of electrically conductive material. A second closely wound coil spring member which is substantially smaller than the first spring member is wound around a portion of the first spring member adjacent one end thereof. The second spring member is anchored to the first spring member by solder which is flowed into the coils of the first and second spring members where they contact each other. The end of the flexible first element to which the second member is attached is situated within a housing of rigid materials having first and second ends which include upper and lower apertures, respectively, the second spring member is fixedly held between the first and second ends of the housing. The second spring member with the first spring member therein is situated within the housing such that the portions of the first spring member on either side of the second spring member are situated within the respective apertures in the first and second housing ends. An antenna structure which exhibits high mechanical structural integrity is thus provided.

11 Claims, 2 Drawing Figures

WHIP ANTENNA ASSEMBLY EXHIBITING INCREASED DURABILITY

BACKGROUND OF THE INVENTION

This invention relates to antennas for portable radio device and, more particularly to relatively small flexible antenna assemblies for such portable radio devices.

DESCRIPTION OF THE PRIOR ART

Flexible antennas are known to those skilled in the art and are often colloquially referred to as "rubber duck" antennas because the flexibility of the antenna prevents breakage when the antenna contacts another body. When such contact occurs, the antenna merely flexes without breaking. Unfortunately, flexible antennas are often abused by radio users who hold the radio by grasping the antenna rather than the body of the radio. Conventional flexible antennas are often subject to breakage when used in this abusive manner. Such conventional flexible antennas are typically fabricated by electrically connecting one end of a predetermined length of flexible metallic conductor, for example speedometer cable, to a radio frequency (RF) connector. The flexible conductor is then covered with a layer of electrically insulative material such as molded plastic. The conventional flexible whip antenna is thus formed. Although such antennas generally perform electrically in a satisfactory manner, they tend to be rather weak from the viewpoint of mechanical structural integrity. That is, when the flexible antenna is connected to a portable radio and the radio is supported by the antenna, the flexible conductive member may separate from the radio frequency connector at relatively low stress levels, for example 60 pounds, thus resulting in antenna breakage. Since such antennas are often covered by a molded plastic casing, it may not always be apparent that such separation internal to the antenna has occurred. Intermittent operation or total failure may result.

Accordingly, it is one object of the present invention to provide a flexible antenna which exhibits increased mechanical structural integrity.

Another object of the present invention is to provide a flexible antenna which eliminates the deficiencies of the conventional flexible whip antennas described above.

These and other objects of the invention will become apparent to those skilled in the art upon consideration of the following description.

BRIEF SUMMARY OF THE INVENTION

The present invention is directed to providing a flexible whip antenna assembly for use with portable radio devices and other transmitting and receiving apparatus.

In accordance with one embodiment of the invention, an antenna assembly includes an electrically conductive flexible element having first and second opposed ends. The antenna assembly further includes a housing member for holding the first end of said flexible element in a fixed position. The housing member includes first and second electrically insulative opposed end portions having first and second apertures therein, respectively. A portion of the flexible element adjacent the first end thereof is defined as a mounting portion. The mounting portion of the flexible element is situated extending through the first and second apertures. A clamping member is fixedly held to the mounting portion of the flexible element and is situated between the first and second end portions of the housing member. The clamping member exhibits a diameter sufficiently larger than the diameter of the first and second apertures such that the clamping member is held in place between the first and second end portions of the housing member.

The features of the invention believed to be novel are set forth with particularity in the appended claims. The invention itself, however, both as to organization and method of operation, together with further objects and advantages thereof, may best be understood by reference to the following description taken in conjunction with the accompanying drawings.

DETAILED DESCRIPTION OF THE PREFERRED EMBODIMENT

Figure 1:
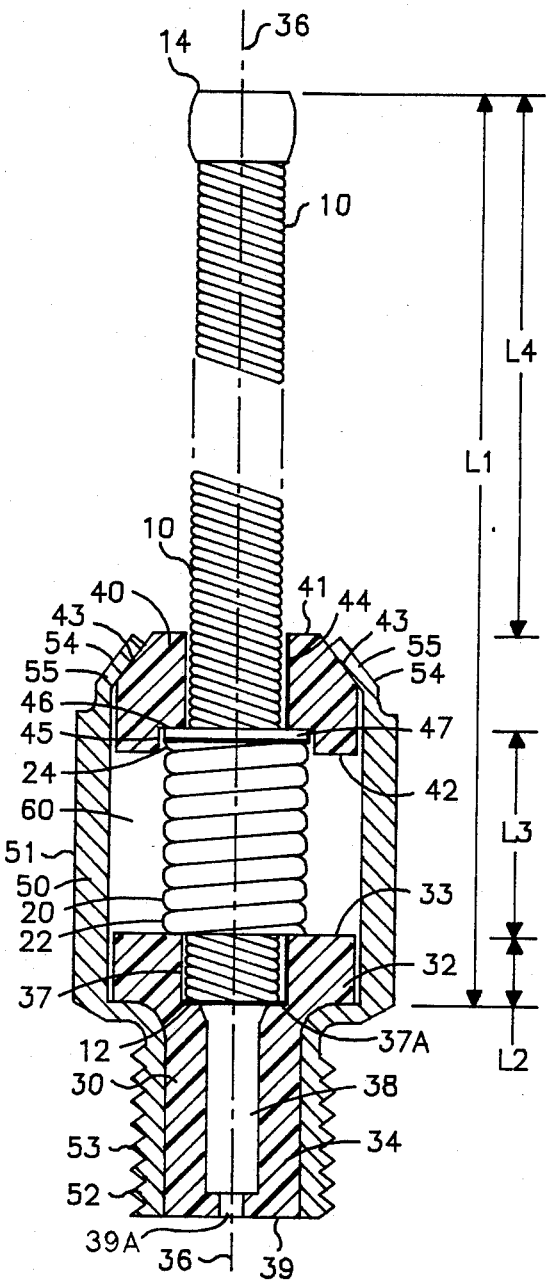
FIG. 1 is a representation of a cut-away view of the antenna assembly of the present invention.

FIG. 1 illustrates a cut-away view of one embodiment of the flexible antenna of the present invention. The antenna of FIG. 1 includes a flexible electrically conductive member 10 preferrably fabricated from closely wound spring-like material, for example, flexible speedometer cable wire. Flexible element 10 exhibits a predetermined length L1 which corresponds to the wavelength or frequency which the antenna of FIG. 1 is to operate. The length of flexible member 10 as it relates to the selected operating frequency for the antenna is discussed later in more detail. Flexible member 10 includes opposed ends 12 and 14. End 12 is the feedpoint of the antenna. In one embodiment of the invention wherein the desired operating frequency of the antenna is equal to approximately 800 MHz, L1 is found to equal approximately 8.9 centimeters. Flexible member 10 is preferably a spring wound in one of either clockwise or counter-clockwise directions, that is left-handed or right-handed, as viewed from end 12.

A second closely wound flexible spring member 20 is wound around a portion of spring member 10 adjacent spring end 12 and oriented separated from end 12 by a predetermined distance L2, which is approximately equal to 0.228 centimeters. Spring member 20 exhibits a length of L3 which is approximately equal to 0.635 centimeters in one embodiment of the invention. Spring member 20 includes opposed ends 22 and 24. Solder is wicked into spring member 20 to fixedly attach spring member 20 to the portion of spring member 10 therein. Spring member 20 is thus anchored or clamped to spring member 10 in a manner which results in substantial structural integrity in the connection therebetween. Spring member 20 is also referred to as clamping member 20 since it will be appreciated that elements other than springs may be employed to anchor to the region of flexible member 10 adjacent end 12, as long as such other elements fixedly attach to member 10 in a substantially non-movable manner and the dimensional criteria for member 10 discussed elsewhere in this description are met. It is found that by winding a spring member 20 (which exhibits a winding direction opposite that of spring member 10) onto spring member 10, such winding is more easily achieved and the integrity of the mechanical attachment of spring member 20 to spring member 10 is enhanced. Spring member 20 is fabricated from electrically conductive material, for example stainless steel and other highly conductive metals.

The antenna of FIG. 1 further includes lower support member 30 and upper support member 40, each being fabricated from electrically insulative material, for example Teflon (Teflon is a trademark of Du Pont) or other plastic-like substances. Lower support member 30 is substantially T-shaped and includes a hat brim portion 32 and a leg portion 34 oriented substantially perpendicular to hat portion 32 in a T-like manner. A longitudinal axis 36 is defined along the center of leg portion 34 and hat portion 32 as shown in FIG. 1. An aperture 37 exhibiting a depth approximately equal to L2 is situated in the center of hat portion 32 at axis 36. The bottom surface of the aperture is designated 37A. A relatively small orifice 39A is situated at axis 36 extending inward from bottom surface 39 of leg 34 as shown in FIG. 1. An electrically conductive member 38 is situated within support member 30 extending from aperture surface 37 to orifice 39A. Electrical contact to the antenna is thus made by suitably contacting conductive member 38 through orifice 39A. The portion of spring member 10 between end 22 of spring member 20 and end 12 of spring member 10 is situated within aperture 37 such that spring end 22 rests on top surface 33 of hat portion 32.

Upper support member 40 is fabricated from electrically insulative material and exhibits a substantially ring-like or washer-like shape as shown in FIG. 1. Upper support member 40 includes upper and lower opposed surfaces 41 and 42. Upper surface 41 is beveled at an angle of approximately 45° as shown in FIG. 1 to form a beveled surface 43 around the periphery of upper support member 40. It is noted that beveled surface 43 forms an angle of approximately 45° with respect to the plane of upper surface 41 of support member 40.

An aperture 44 is situated at the center of upper support member 40 between surfaces 41 and 42, thereof. Apertures 37 and 44 are axially aligned with each other and with axis 36. Aperture 44 exhibits a diameter substantially the same of as the diameter of flexible member 10, but sufficiently large to permit flexible member 10 to be situated therein. The outer diameter of spring or clamping member 20 is selected to be larger than the diameter of aperture 37 and aperture 44 such that spring member 20 is captured therebetween. In other words, apertures 37 and 44 have a diameter sufficiently large to accommodate flexible 10 therein and sufficiently small to captivate spring member 20 between upper support member 40 and lower support member 30. For example, with flexible member 10 and spring member 20 exhibiting outer diameters of approximately 0.241 and approximately 0.317 centimeters, respectively, apertures 37 and 44 have a diameter of 0.249 centimeters in one embodiment of the antenna. A recessed region 45 is situated at the center of bottom surface 42. Recessed region 45 exhibits a diameter sufficiently large to accommodate the diameter of spring or clamping member 20 therein as shown in FIG. 1. A shoulder 46 is thus formed in recessed region 45. A ring-like washer 47 having an inner diameter approximately equal to the diameter of spring member 10 and an outer diameter approximately equal to the diameter of spring member 20 is situated over sprng member 10 at end 24 of spring member 20. Spring member 10 with the spring member 20 and washer 47 assembled thereon is then passed through aperture 44 until washer 47 and spring end 24 rest within recessed region 45. Washer 47 rests between end 24 and shoulder 46. It is noted that in the assembly thus formed, apertures 44 and 37 share a common axis 36.

The antenna of FIG. 1 includes a housing 50 of rigid bendable material, for example, a metallic material such as stainless steel. Housing 50 includes a substantially cylindrical main body 51 and a connector portion 52. Main body 51 exhibits a diameter sufficiently large to accommodate upper support member 40 and the hat portion 32 of lower support 30 therein. Housing 50 narrows at the base thereof to form connector portion 52 which includes threads 53 for screwing the antenna of FIG. 1 into an appropriate antenna jack in a portable radio or similar device. Connector portion 52 exhibits a diameter sufficiently large to accommodate the leg portion 34 of lower support 30 therein.

It is noted that prior to assembling the antenna of the invention, the upper end surface 54 of the main body 51 adjacent support member 40 is parallel with axis 36. In one method for assembling the antenna of the invention, all of the components of the antenna are situated in the position shown in FIG. 1. As stated above, upper end surface 54 is initially parallel to axis 36. That is, upper end surface 54 is in the unbent or uncrimped state. Upper surface 54 of main body 51 is then crimped inward at an angle of approximately 45° toward axis 36 to form a beveled crimped region 55. Crimped region 55 conforms to the angle of beveled surface 43 of upper support member 40, thus holding the assembly formed by spring members 10 and 20, upper and lower support members 40 and 30, and housing 50 together in a manner resulting in an antenna structure exhibiting substantial structural integrity. That is, when the antenna structure thus formed is mounted on a portable radio or similar device, relatively large amounts of stress can be successfully exerted on end 14 of flexible spring member 10 without spring member 10 being pulled out of the combined antenna assembly. The antenna of the invention exhibits sufficient structural integrity to support a portable radio device without breakage of the antenna even with relatively high stress levels applied thereto. The antenna has been successfully subjected to pull tests wherein approximately 120 pounds of force were exerted along axis 36 without member 10 separating from housing 50.

As seen in FIG. 1, the crimped portion 55 of housing 50 extends sufficiently far over beveled surface 43 to hold the antenna assembly together, but not so far as to cause an electrical short circuit between spring member 10 and housing 50. With the antenna thus assembled, it is noted that a cavity 60 is formed within housing 50. Spring member 20 with flexible spring member 10 therein is centered at the middle of such cavity 60 along axis 36. It is seen that support members 30 and 40 act to hold spring member 20 in the middle of cavity 60 thus resulting in spring member 20 and flexible spring member 30 being held in place in a manner such that members 10 and 20 are insulated from housing 50.

Figure 2:
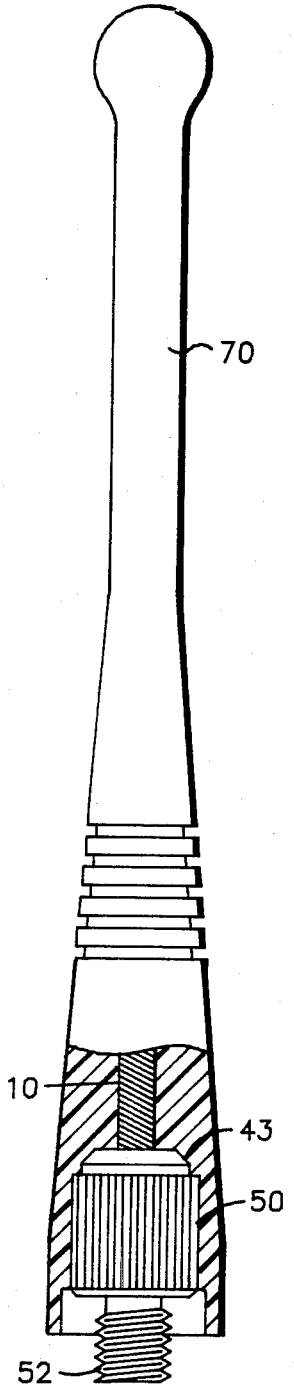
FIG. 2 is a representation of the antenna of FIG. 1 with a protective plastic coating molded thereover.

The length of the portion of flexible element 10 extending beyond housing member 50 is defined to be L4 as seen in FIG. 1. In one embodiment of the invention wherein the desired operating frequency of the antenna is approximately 806 MHz, L4 is found to exhibit a length of approximately 7.7 centimeters. FIG. 2 illustrates the antenna of the present invention with a protective plastic jacket 70 thereon. Jacket 70 is illustrated as being removed on the lower portion of the antenna near connector 52 to show the components under jacket 70. Protective jacket 70 is conveniently formed by molding plastic material over the antenna of FIG. 1 with a mold corresponding to the shape of the completed antenna of FIG. 2.

The foregoing describes a flexible antenna for portable radios and similar devices. The antenna exhibits a relatively high structural integrity and is capable of supporting a portable radio or similar device attached thereto.

While only certain preferred features of the invention have been shown by way of illustration, many modifications and changes will occur to those skilled in the art. It is, therefore, to be understood that the present claims are intended to cover all such modifications and changes as fall within the true spirit of the invention.

What is claimed is:

1. An antenna comprising:

a first closely wound coil spring member of electrically conductive material having opposed ends and exhibiting a first predetermined length, one end of said first member being designated the feedpoint of said antenna, said first spring member being wound in one of clockwise and counter-clockwise directions as viewed from said antenna feedpoint;

a second closely wound coil spring member having opposed ends and exhibiting a second predetermined length substantially less than said first predetermined length, said second spring member being wound around a portion of said first member adjacent said feedpoint in the remaining direction of said clockwise and counter-clockwise directions such that said second spring member is fixedly anchored to said first spring member, and a housing of rigid material having first and second opposed housing ends, and upper and lower apertures aligned on a common axis and situated at said first and second housing ends, respectively, said second spring member being situated between the first and second housing ends with the first member therein extending through the upper aperture at one end of said second spring member and extending into the lower aperture at the remaining end of the second spring member, each aperture exhibiting a diameter sufficiently large to accommodate said first member therein and sufficiently small to captivate said second member between said first and second housing ends.

2. The antenna of claim 1 including means for fixedly holding said second spring member to said first spring member.

3. The antenna of claim 2 wherein said first and second spring members each include a plurality of turns.

4. The antenna of claim 3 wherein said means for holding comprises solder being disposed among the turns of said second spring member and the portion of said first spring member enclosed by said second spring member.

5. The antenna of claim 1 wherein the portion of said first predetermined length of said first spring member outside of said housing exhibits a length approximately equal to one-quarter of the wavelength at the desired operating frequency for said antenna.

6. The antenna of claim 1 wherein said first spring member comprises electrically conductive speedometer cable.

7. The antenna comprising:

a first closely wound coil spring member of electrically conductive material having opposed ends and exhibiting a first predetermined length, one end of said first member being designated the feedpoint of said antenna, said first spring member being wound in one of clockwise and counter-clockwise directions as viewed from said antenna feedpoint;

a second closely wound coil spring member having opposed ends and exhibiting a second predetermined length substantially less than said first predetermined length, said second spring member being wound around a portion of said first member adjacent said feedpoint in the remaining direction of said clockwise and counter-clockwise directions such that said second spring member is fixedly anchored to said first spring member;

a substantially cylindroidal housing of metallic material having opposed ends;

first and second electrically insulative members situated at the opposite ends of said housing, respectively, said first and second insulative members each having an aperture therein, each aperture being situated on a common axis located running through respective centers of said opposed ends, each aperture exhibiting a diameter sufficient to accommodate said first spring member therein and sufficiently small to captivate said second member within said housing, the end of said housing away from said feedpoint being crimped toward said common axis to hold said first and second spring members and said first and second electrically insulative members in place within said housing.

8. The antenna of claim 7 wherein the insulative member furtherest from said feedpoint includes a beveled surface for receiving said crimped portion thereon.

9. An antenna comprising:

a first closely wound coil spring member of electrically conductive material having opposed ends and exhibiting a first predetermined length, one end of first said member being designated the feedpoint of said antenna, said first spring member being wound in one of clockwise and counter-clockwise directions as viewed from said antenna feedpoint;

a second closely wound coil spring member having opposed ends and exhibiting a second predetermined length substantially less than said first predetermined length, said second spring member being wound around a portion of said first member adjacent said feedpoint in one of said clockwise and counter-clockwise directions such that said second spring member is fixedly anchored to said first spring member, and a housing of rigid material having first and second opposed housing ends, an upper aperture situated in said first housing end, said second spring member being situated within the housing between the first and second housing ends with the first member therein extending through the upper aperture at one end of said second spring member, the upper aperture exhibiting a diameter sufficiently large to accommodate said first member therein and sufficiently small to captivate said second member between said first and second housing ends.

10. The antenna of claim 9 wherein said first predetermined length is approximately equal to one quarter of the wavelength at the desired operating frequency of the antenna.

11. The antenna of claim 9 wherein solder is disposed between the first and second members to anchor the members.

* * * * *